United States Patent [19]

Bettencourt

[11] 4,271,756

[45] Jun. 9, 1981

[54] LOAD RETRACTION PREVENTING FINGER ARRAY

[75] Inventor: Darryl G. Bettencourt, Lodi, Calif.

[73] Assignee: Blackwelders, Rio Vista, Calif.

[21] Appl. No.: 104,958

[22] Filed: Dec. 18, 1979

[51] Int. Cl.[3] ..... B30B 15/00

[52] U.S. Cl. ..... 100/220; 100/233; 100/229 A; 414/525 R

[58] Field of Search ..... 100/220, 229 A, 233, 100/187; 414/525 R

[56] References Cited

U.S. PATENT DOCUMENTS

| | | | |
|---|---|---|---|
| 379,414 | 3/1888 | Reeder | 100/220 |
| 521,511 | 6/1894 | Schulze | 100/220 |
| 2,730,255 | 1/1956 | Gibson et al. | 414/525 R |
| 2,813,641 | 11/1957 | Starr | 414/525 R |
| 3,370,525 | 2/1968 | Bowles | 100/229 A |
| 3,499,558 | 3/1970 | Rey | 414/525 R |
| 3,508,673 | 4/1970 | Pappas | 414/525 R |
| 3,767,068 | 10/1973 | Herpich et al. | 414/525 R |
| 3,799,375 | 3/1974 | Herpich et al. | 414/525 R |
| 3,844,493 | 10/1974 | Demenais | 414/525 R |
| 4,042,133 | 8/1977 | Smith | 414/525 R |

*Primary Examiner*—Billy J. Wilhite

*Attorney, Agent, or Firm*—Roger B. Webster

[57] ABSTRACT

A load retraction preventing finger array for a unitary heavy-duty refuse compactor which includes a hopper from which pre-deposited refuse is forcefully thrust by a power-advanced packing blade through an intermediate throat and into a large, normally closed, box-like container which provides a packing chamber in which the load—as it progressively increases in volume upon recurrent operation of the packing blade—is thereby placed under compression; the load retraction preventing finger array embodying a plurality of initially depending, pivoted, dual finger units mounted in a horizontal transverse row extending across the top of such throat and operative in certain positions of engagement with the load of compressed refuse to substantially preclude such load from falling back (by reason of its tendency to expand) through the throat and into the hopper upon retraction of the packing blade.

8 Claims, 5 Drawing Figures

LOAD RETRACTION PREVENTING FINGER ARRAY

BACKGROUND OF THE INVENTION

1. Field of the Invention

In heavy-duty refuse compactors there is a tendency for the load, when under compression, to spring or fall back into the receiving hopper from the packing chamber when the packing blade retracts in such hopper from an advancing or packing stroke. While various devices have heretofore been provided in heavy-duty refuse compactors in an effort to prevent such undesirable occurrence, none have met with substantial commercial success either by reason of complex and costly structure or less-than-efficient operation. The present invention was conceived in a successful effort to provide a device for the purpose which is not subject to such objections.

2. The Prior Art

Applicant is not aware of any issued United States patent, or other prior at, disclosing the structure and function of the load retraction preventing finger array shown and claimed herein.

SUMMARY OF THE INVENTION

The present invention provides, as a major object, a novel load retraction preventing finger array for a unitary heavy-duty refuse compactor which includes a hopper from which pre-deposited refuse is forcefully thrust by a power-advanced packing blade through an intermediate throat and into a large, normally closed, box-like container which provides a packing chamber in which the load—as it progressively increases in volume upon recurrent operation of the packing blade—is thereby placed under compression; the load retraction preventing finger array embodying a plurality of initially depending, pivoted, dual finger units mounted in a horizontal transverse row extending across the top of such throat and operative in certain positions of engagement with the load of compressed refuse to substantially preclude such load from falling back (by reason of its tendency to expand) through the throat and into the hopper upon retraction of the packing blade.

The present invention provides, as another important object, a load retraction preventing finger array, as above, wherein the dual finger units each include a pair of side-by-side, pivotally mounted, initially depending, fingers of which one is substantially longer than the other; the fingers of each such unit being positionally responsive to certain movements of the packing blade and effectively function, for the desired purpose, as will be later described.

The present invention provides, as a further object, a load retraction preventing finger array which is designed for ease and economy of manufacture, and long use without maintenance problems.

The present invention provides, as a still further object, a practical, reliable, and durable load retraction preventing finger array, and one which is exceedingly effective for the purpose for which it is designed.

DESCRIPTION OF THE PREFERRED EMBODIMENT

Figure 1:
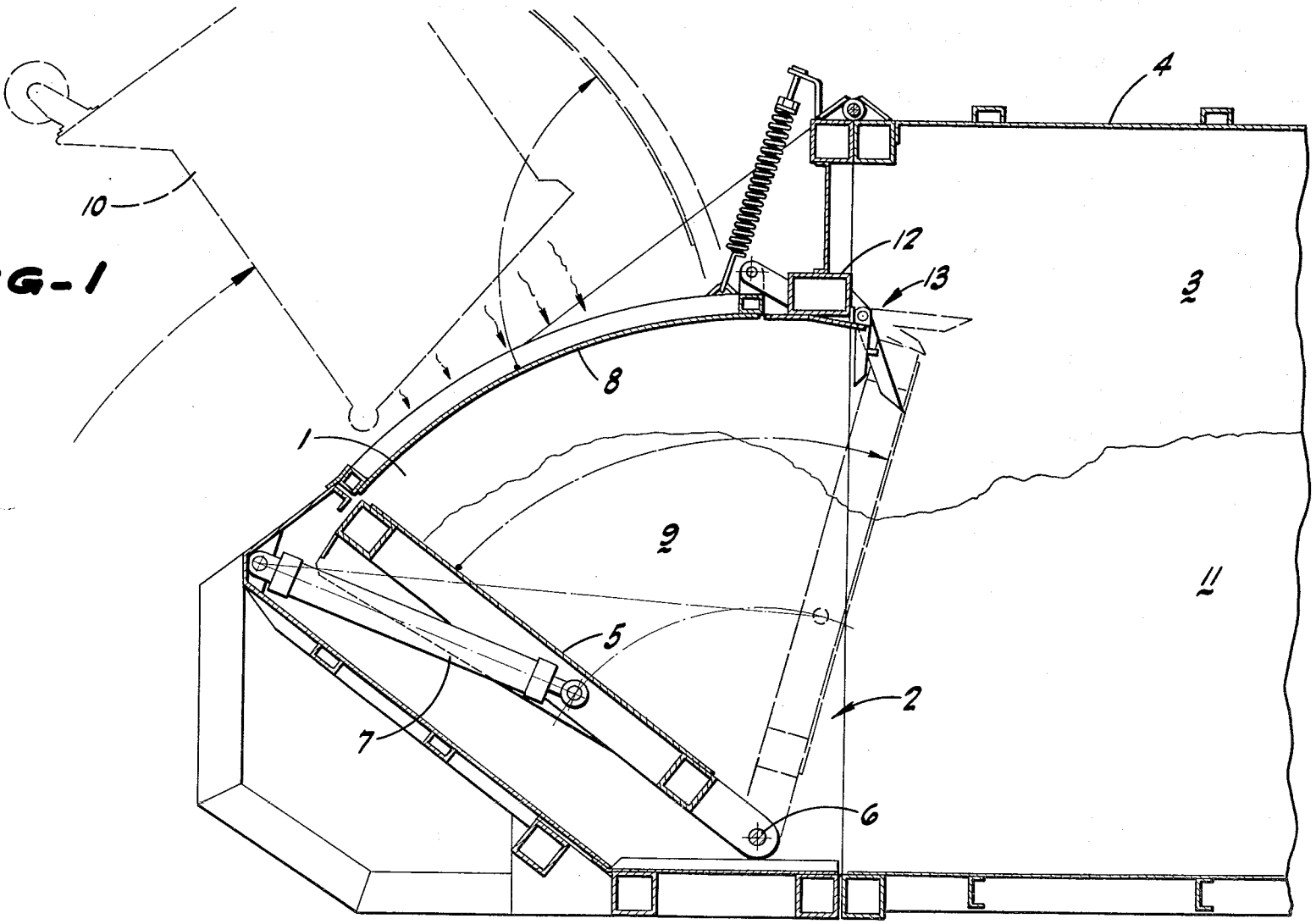
FIG. 1 is a somewhat fragmentary, longitudinal sectional elevation of a refuse compactor embodying the load retraction preventing finger array of the present invention; the packing blade and fingers being shown in full lines in their initial positions, and in broken lines in the positions occuped thereby upon full advance of the packing blade.
Figure 2:
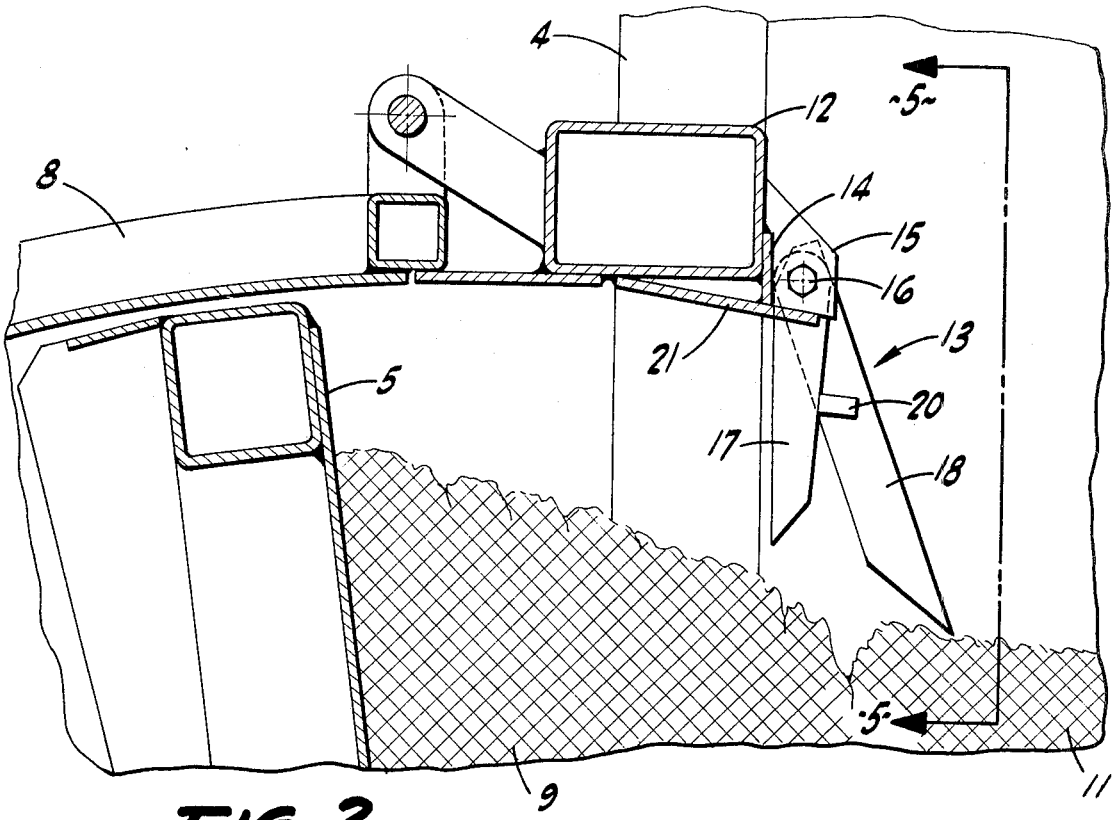
FIG. 2 is a similar, but enlarged and more fragmentary, view showing the packing blade in a position of advance short of the fingers, and with the latter in their initial depending positions.

Referring now more particularly to the drawings and to the characters of reference marked thereon, the load retraction preventing finger array, of the present invention, is embodied in a heavy-duty, commercial-type refuse compactor which includes the following:

A hopper 1, adapted for the deposit of refuse, communicates through a throat 2 with a packing chamber 3 formed by a large, normally closed, box-like container 4. A packing blade 5, in and adapted to sweep through the hopper, is pivoted adjacent its lower edge, as at 6; the packing blade being power-advanced and retracted by a power cylinder assembly 7, and such packing blade—when fully advanced—extending at its upper portion through the throat 2. See FIG. 1 and the broken line position of the packing blade.

The hopper 1 includes a normally but releasably latched, pivotally mounted, spring-balanced lid 8 which, when unlatched and opened, permits the deposit of refuse 9 into the hopper from an inverted refuse bin 10—all as indicated in broken lines in FIG. 1.

After the pre-deposit of refuse in hopper 1, and with lid 8 closed and latched, the power cylinder assembly 7 is actuated which causes forceful advance of the packing blade 5 and which sweeps the refuse 9 from the hopper, through throat 2, and into the packing chamber 3 of container 4; the refuse as thus introduced into the packing chamber 3 being indicated at 11 in FIG. 1.

Figure 5:
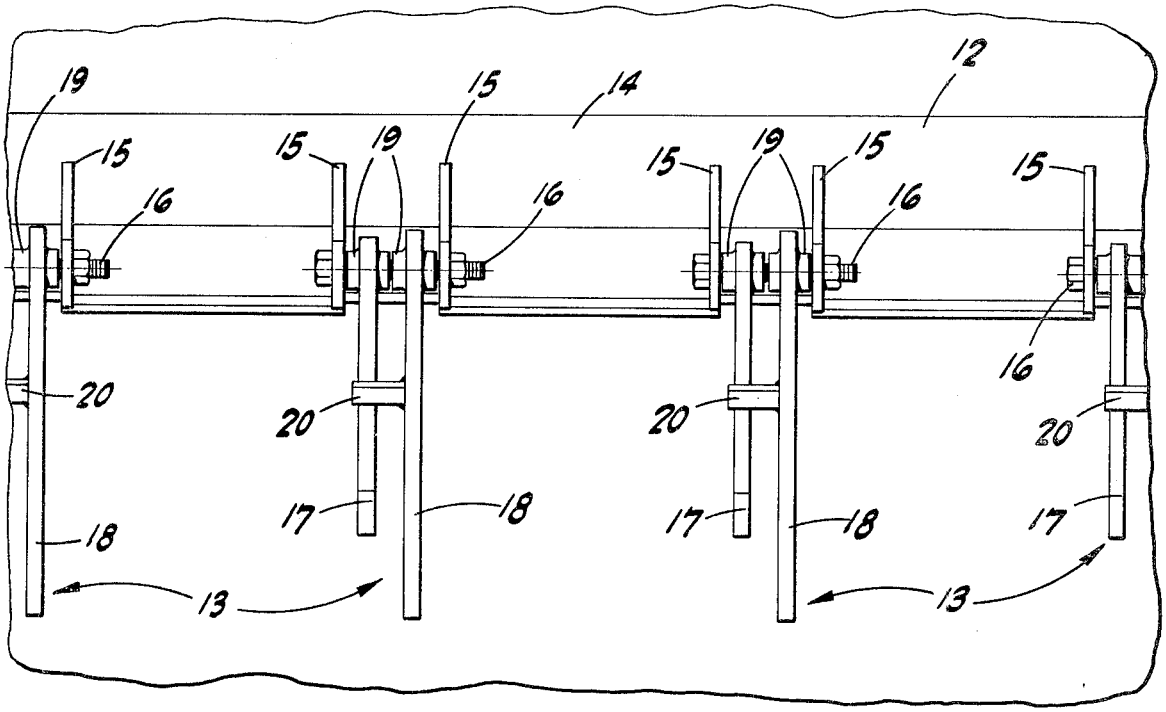
FIG. 5 is a fragmentary transverse vertical section taken substantially on line 5—5 of FIG. 2; the view showing several of the separate dual finger units which are included in the load retraction preventing finger array.

Upon recurrent thrusting of refuse, by the packing blade, through throat 2, and into the packing chamber 3, the load of refuse in the latter is ultimately placed under compression, with the result that each time the packing blade 5 retracts to its starting position, there is a tendency of the compressed load to expand and, in part at least, to fall back into the hopper—reducing its capacity for reception of the next quantity of refuse deposited therein. The function of the present invention is to substantially prevent such undesirable occurrence, and this is accomplished by the present load retraction preventing finger array, and which is constructed as follows:

At the top of the throat 2, the compactor includes a rigid, horizontal, cross beam 12, and a plurality of dual finger units, each indicated generally at 13, are mounted in connection with and depend from said cross beam 13 in a horizontal, transverse row wherein such finger units are disposed in adjacent but spaced-apart relation. See FIG. 5.

More particularly, a transverse mounting and stop plate 14 is affixed to the forward, lower portion of cross beam 12, and the dual finger units 13 are each provided with forwardly extending, transversely spaced mounting brackets 15 secured both to the plate 14 and adjacent portion of the cross beam 12. A cross bolt 16 spans between corresponding brackets 15 and provides the pivotal axis for two depending, heavy-duty, bevel-pointed, fingers indicated at 17 and 18; the finger 17 being relatively short while the finger 18 is of substantially greater length, as shown. The fingers 17 and 18 include hubs 19 which are journaled on the cross bolt 16.

A lug 20 projects laterally from the long finger 18 intermediate the ends thereof and in a direction such that the lug intersects and initially rests against the forward edge of short finger 17. In its initially depending position, the short finger 17 rear-edge abuts at the upper portion, but below its pivot, against the plate 14, and which—as a stop—prevents the short finger from swinging rearwardly beyond vertical. At the same time, the initially depending position of the long finger 18 is held at a slight forward and downward incline; this by reason of lug 20 resting against the forward edge of the short finger 17. This is the starting position of the fingers 17 and 18 of each dual finger unit 13.

Also, it is to be noted that the normally upper or pivoted end of each long finger 18 is configured so as to abut plate 14 as a stop and preclude such long finger from swinging forward and upward beyond horizontal.

Deflector plates 21 are mounted between the dual fingers units 13 to aid in proper flow of refuse from the hopper 1, through throat 2, and into the packing chamber 3.

The above-described load retraction preventing finger array is operative, essentially, in the following manner.

Upon each advance of the packing blade 5, the pre-deposited refuse 9 in the hopper 1 is thrust through the throat 2 and into the packing chamber 3; the packing blade—at its point of maximum advance—engaging at the top with and up-swinging the short fingers 17 to a raised, forwardly projecting position and, in turn and by reason of the lugs 20, correspondingly swings the long fingers 18 to a raised, forwardly projecting position in which said long fingers are substantially horizontal.

As long as the refuse is in loose-pack condition in the packing chamber 3, the fingers 17 and 18 of each finger unit 13 normally gravitate downward, to their initial depending position, upon retraction of the packing blade 5 and its escape from said fingers.

Figure 3:
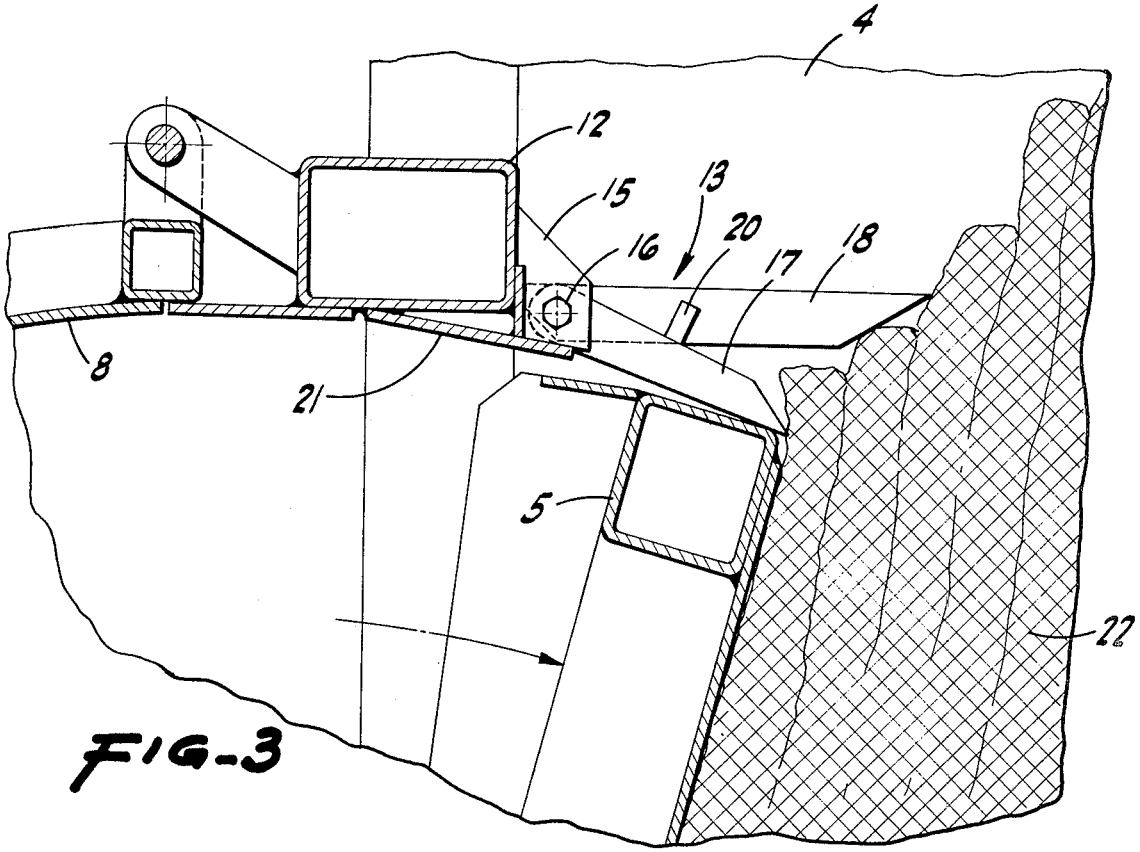
FIG. 3 corresponds to FIG. 2, but shows the packing blade as fully advanced, and the fingers in the projecting positions to which they are then swung by said packing blade.
Figure 4:
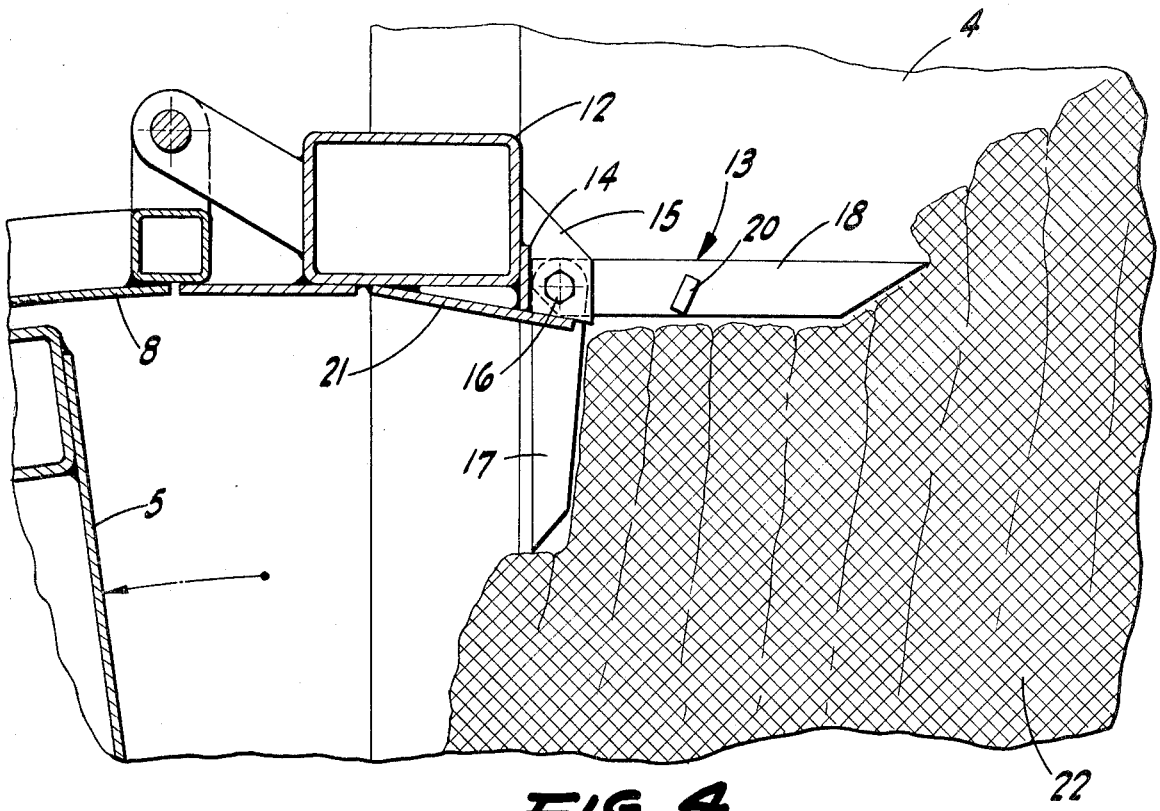
FIG. 4 is a like view but shows the positions of the fingers upon retraction of the packing blade and when the load of refuse in the packing chamber is under compression.

However, upon successive quantities of refuse being forcefully fed into the packing chamber 3, a compression of the refuse load in said chamber occurs and, hence, each time that the packing blade 5 retracts, the compressed load tends to expand, and which heretofore caused such compressed load to partially fall back—undesirably—through the throat 2 and into hopper 1. Such falling back of the compressed load is, however, substantially prevented by the herein-described finger array. This occurs by reason of the fact that when the fingers 17 and 18 are all swung upward, by the packing blade 5, to a forwardly projecting position, as previously described, the long fingers 18 then end-engage the compressed load 22 (see FIG. 3) and substantially prevent it from falling back. Under this condition the long fingers 18 remain raised and in projection against the load when the packing blade 5 retracts. The short fingers 17, however, then frequently gravitate to their initial depending position and then provide edge-engagement with and consequent further resistance against expansion and falling back of the compressed load in packing chamber 3. See FIG. 4. However, under a condition of very heavy compression of the load 22 in packing chamber 3, both the long and short fingers may remain raised and in end-engagement with the compressed load when the packing blade 5 retracts.

All of the load-engaging fingers, upon discharge of the load from the container, do—of course—return by gravity to their initially depending positions.

From the foregoing description, it will be readily seen that there has been produced such a load retraction preventing finger array as substantially fulfills the objects of the invention, as set forth herein.

While this specification sets forth in detail the present and preferred construction of the load retraction preventing finger array, still in practice such deviations from such detail may be resorted to as do not form a departure from the spirit of the invention as defined by the appended claims.

I claim:

1. In a refuse compactor which includes a hopper for the reception of refuse, a container forming a packing chamber, there being a throat between the hopper and packing chamber, and a power-actuated packing blade mounted in the hopper and operative upon advance of such blade to forcefully and recurringly thrust pre-deposited refuse from the hopper, through the throat, and into the packing chamber whereby the resultant load therein is ultimately placed under compression; a load retraction preventing finger array comprising a transversely extending row of spaced-apart fingers disposed adjacent the top of the throat, means pivotally mounting the fingers of said row for forward and upward swinging from an initially depending position to a forwardly projecting position, and means arranged so that all the fingers, upon the packing blade being advanced, are so swung by the blade to said forwardly projecting position; the forwardly projecting fingers, at least in part, being engaged, and held in such projection, by the load of refuse in the packing chamber when such load is under compression and tends to expand; a number of said fingers being of greater length than others thereof, and the fingers of greater length being, at least, those which in such projection are end-engaged by the compressed load of refuse.

2. In a refuse compactor which includes a hopper for the reception of refuse, a container forming a packing chamber, there being a throat between the hopper and packing chamber, and a power-actuated packing blade mounted in the hopper and operative upon advance of such blade to forcefully and recurringly thrust pre-deposited refuse from the hopper, through the throat, and into the packing chamber whereby the resultant load therein is ultimately placed under compression; a load retraction preventing finger array comprising a transversely extending row of spaced-apart fingers disposed adjacent the top of the throat, means pivotally mounting the fingers of said row for forward and upward swinging from an initially depending position to a forwardly projecting position, and means arranged so that all the fingers, upon the packing blade being advanced, are so swung by the blade to said forwardly projecting position; the forwardly projecting fingers, at least in part, being engaged, and held in such projection, by the load of refuse in the packing chamber when such load is under compression and tends to expand; adjacent fingers being of differential length, the fingers of one length being engaged and swung upward to said projecting position by the packing blade upon advance thereof, and said last-named means includes finger-mounted lugs arranged so that upon the fingers of said one length being swung upward to said projecting position, finger-lug engagement causes the fingers of the other length to likewise swing upward to said projecting position.

3. A load retraction preventing finger array, as in claim 2, in which the fingers are in pairs, each pair including a long finger and an adjacent short finger; the lugs being fixed on the long fingers and engaging in intersection with the forward edges of the corresponding short fingers whereby when the latter are swung upward to projecting position, the long fingers are likewise swung.

4. In a refuse compactor which includes a hopper for the reception of refuse, a container forming a packing chamber, there being a throat between the hopper and packing chamber, and a power-actuated packing blade mounted in the hopper and operative upon advance of such blade to forcefully and recurringly thrust pre-deposited refuse from the hopper, through the throat, and into the packing chamber whereby the resultant load therein is ultimately placed under compression; a load retraction preventing finger array comprising a transversely extending row of spaced-apart fingers disposed adjacent the top of the throat, means pivotally mounting the fingers of said row for forward and upward swinging from an initially depending position to a forwardly projecting position, and means arranged so that all the fingers, upon the packing blade being advanced, are so swung by the blade to said forwardly projecting position; the forward projecting fingers, at least in part, being engaged, and held in such projection, by the load of refuse in the packing chamber when such load is under compression and tends to expand; the fingers being in pairs, each pair including one finger of greater length than the other, the fingers being co-axially pivoted adjacent the upper ends thereof, and stop means preventing the short fingers from swinging rearward beyond said initially depending position, lugs projecting laterally from the long fingers and spanning in front of the corresponding short fingers, the packing blade, upon advance thereof, engaging and swinging the short fingers upward to projecting position, and the short fingers as engaged with the lugs then swing the long fingers upward to projecting position.

5. In a refuse compactor which includes a hopper for the reception of refuse, a container forming a packing chamber, there being a throat between the hopper and packing chamber, and a power-actuated backing blade mounted in the hopper and operative upon advance of such blade to forcefully and recurringly thrust pre-deposited refuse from the hopper, through the throat, and into the packing chamber whereby the resultant load therein is ultimately placed under compression; a load retraction preventing finger array comprising a transverely extending row of spaced-apart fingers disposed adjacent the top of the throat, means pivotally mounting the fingers of said row for forward and upward swinging from an initially depending position to a forwardly projecting position, and means arranged so that all the fingers, upon the packing blade being advanced, are so swung by the blade to said forwardly projecting position; the forwardly projecting fingers, at least in part, being engaged, and held in such projection, by the load of refuse in the packing chamber when such load is under compression and tends to expand; the depending fingers being in pairs, each pair including one finger of greater length than the other, there being a transverse member adjacent the top of the throat, the fingers of said pairs all being co-axially pivoted at their upper ends in connection with the transverse member for said forward and upward swinging from such initially depending position to a forwardly projecting position, the short fingers when in initially depending position engaging below their pivots with the transverse member as a stop which prevents the short fingers from swinging rearward beyond said depending position, and lugs projecting laterally from the long fingers and spanning in engagement in front of the short fingers, the long fingers being held, by such engagement of the lugs with the short fingers, in an initially depending position slightly ahead of the latter and at a slight forward and downward incline, the packing blade, upon advance thereof, engaging and swinging the short fingers upward to projecting position, and the short fingers as engaged with the lugs then swinging the long fingers upward to projecting position.

6. In a refuse compactor which includes a hopper for the reception of refuse, a container forming a packing chamber, there being a throat between the hopper and packing chamber, and a power-actuated packing blade mounted in the hopper and operative upon advance of such blade to forcefully and recurringly thrust pre-deposited refuse from the hopper, through the throat, and into the packing chamber whereby the resultant load therein is ultimately placed under compression; a load retraction preventing finger array comprising a horizontal, transversely extending mounting plate adjacent the top of the throat, a transversely extending row of depending, spaced-apart fingers adjacent the mounting plate, the fingers being in pairs wherein the individual fingers are of differential lengths, means pivoting the upper ends of the fingers in connection with the mounting plate, the fingers as so pivoted being swingable, from an initially depending position, forwardly and upwardly to a forwardly projecting position, the depending fingers of one length being engaged by and swung upward to said projecting position by and upon advance of the packing blade, and means between the fingers of the pairs arranged to cause the fingers of the other length to swing upward to said projecting position with the fingers of said one length.

7. A load retraction preventing finger array, as in claim 6, in which said means between the fingers of the pairs comprises a projecting lug on one finger of each pair which engages the other finger of such pair.

8. A load retraction preventing finger array, as in claim 6, in which the means pivoting the fingers comprises, for each pair, spaced brackets fixed on the mounting plate, the fingers of each pair having hubs at their upper ends, the hubs being end to end between the related brackets, and an axial element spanning between the spaced brackets and on which the hubs are journaled.

* * * * *